United States Patent [19]

LeDoux et al.

[11] 4,453,692

[45] Jun. 12, 1984

[54] SECURITY DEVICE

[76] Inventors: William D. LeDoux, 5545 Marconi Ave., #225, Carmichael, Calif. 95608; Allan A. Johannes, 4905 Arbor Dr., Sacramento, Calif. 95834

[21] Appl. No.: 286,823

[22] Filed: Jul. 27, 1981

[51] Int. Cl.[3] ..... E05B 73/00

[52] U.S. Cl. ..... 248/552; 70/58; 70/164; 248/505

[58] Field of Search ..... 248/551, 552, 553, 505, 248/500, 680, 681, DIG. 5; 211/4, 8; 70/258, 58, 57, 62, 163, 164

[56] References Cited

U.S. PATENT DOCUMENTS

| | | | |
|---|---|---|---|
| 475,745 | 5/1892 | Anderson | 248/505 X |
| 603,544 | 5/1898 | Wagenblast | 211/4 X |
| 938,082 | 10/1909 | Siegel | 248/505 X |
| 1,825,726 | 10/1931 | Gredell | 70/164 X |
| 2,326,481 | 8/1943 | Meyer | 248/505 X |
| 2,402,682 | 6/1946 | Shriro et al. | 248/505 |
| 3,837,545 | 9/1974 | Rogers, Jr. | 248/552 X |
| 4,116,342 | 9/1978 | Winfree, Jr. | 211/68 |
| 4,198,026 | 4/1980 | Capolupo | 248/552 |
| 4,353,521 | 10/1982 | Webb | 248/552 |

FOREIGN PATENT DOCUMENTS

| | | | |
|---|---|---|---|
| 2063344 | 6/1981 | United Kingdom | 70/58 |

*Primary Examiner*—J. Franklin Foss
*Assistant Examiner*—David L. Talbott
*Attorney, Agent, or Firm*—Donald J. Singer; Jacob N. Erlich

[57] ABSTRACT

A security device for protecting a preselected article against theft, while nevertheless permitting the continued use of the protected article. The device includes: a desk top, table top, or the like for supporting the article; a frame structure fitted over and around the article, and, thereby, enclosing it; at least two anchor studs passing through the support and engaging the frame structure; and, a padlock for each anchor stud, with the shackle of each padlock passing through an opening in each stud, thereby preventing the removal of the frame structure. This security device is ideally suited for use as an anti-theft device in preventing the theft or unauthorized removal of easily removal peripheral computer equipment (e.g., a line printer, a video display terminal, and the like) which, while protected, must still be useable.

5 Claims, 3 Drawing Figures

SECURITY DEVICE

STATEMENT OF GOVERNMENT INTEREST

The invention described herein may be manufactured and used by or for the government for governmental purposes without the payment or any royalty thereon.

BACKGROUND OF THE INVENTION

This invention relates to a security device (i.e., a releasably lockable device) and more particularly to an anti-theft device for preventing the pilferage of easily removable peripheral computer equipment (such as a line printer, a video display terminal, and the like), irrespective of whether the computer is remote or nearby.

Because of the rapid advances in the electronics art, and the resultant ready availability of electronics devices (such as computer and computer-related equipment) to even the smallest businesses, theft and burglary of electronically-operated equipment have increased greatly. This is because: firstly, there is a great need for this equipment; secondly, the equipment is small, light in weight, and easily carried away manually; and, thirdly, businesses have known operating hours, and after closing are easily vulnerable to break-ins and to the theft of such items therein.

It is fair and accurate to say that, although there are many prior art anti-theft devices for use with office equipment, none of the known devices are specifically for, or easily useable with, computer-related equipment which must continue to be useable while being protected. Therefore, what is needed in the art, and is not readily available, is a device which will protect easily removable peripheral computer equipment against theft or unauthorized temporary removal, and which will at the same time permit use of the protected equipment.

SUMMARY OF THE INVENTION

The instant invention not only performs the goal of protecting computer related equipment against theft or unauthorized temporary removal, but also permits the use of the equipment while the equipment is being protected. It, therefore, fulfills a genuine presently-existing need, and comprises a significant advance in the state-of-the-art.

An oversimplified structural description of the instant invention is that the device comprises, in combination: a support for the piece of computer-related equipment (i.e., such as the aforesaid line printer, or video display terminal, or the like) which is to be protected; a frame structure which is dimensioned and configurated to enclose a piece of the equipment, with the frame structure fitted over and around the piece of equipment, but not interfering with its operation; at least two anchor studs passing through the top (or outer surface) of the support on which the piece of equipment is located, with the studs engaging the frame structure; and, a padlock for each anchor stud, with each padlock having a shank which passes through a corresponding hole in each stud, thereby preventing the removal of the frame structure.

Accordingly, it is an object of the instant invention to provide a novel securing device for protecting a computer-related piece of equipment from being stolen or from being removed without authorization.

It is another object of the instant invention to permit use of the piece of equipment, while the equipment is concurrently being protected by the instant invention.

It is still another object of the instant invention to provide the aforesaid security device which also is simple in structure, easy to manufacture, and low in cost.

It is a further object of the instant invention to provide the aforesaid security device which also is easy and quick for the user to install and to remove.

It is another further object of the instant invention to provide the aforesaid security device which also is reliable, while at the same time is not unsightly.

It is still another further object of the instant invention to provide the aforesaid security device which, although intended primarily for use with computer-related equipment, is capable of being used (or of being adapted to being used) with other than computer-related pieces of equipment.

The objects of the instant invention, as well as other objects related thereto, will become readily apparent after a consideration of the description of the invention, together with reference to the contents of the Figures of the drawing.

DESCRIPTION OF THE PREFERRED EMBODIMENT

Figure 1:
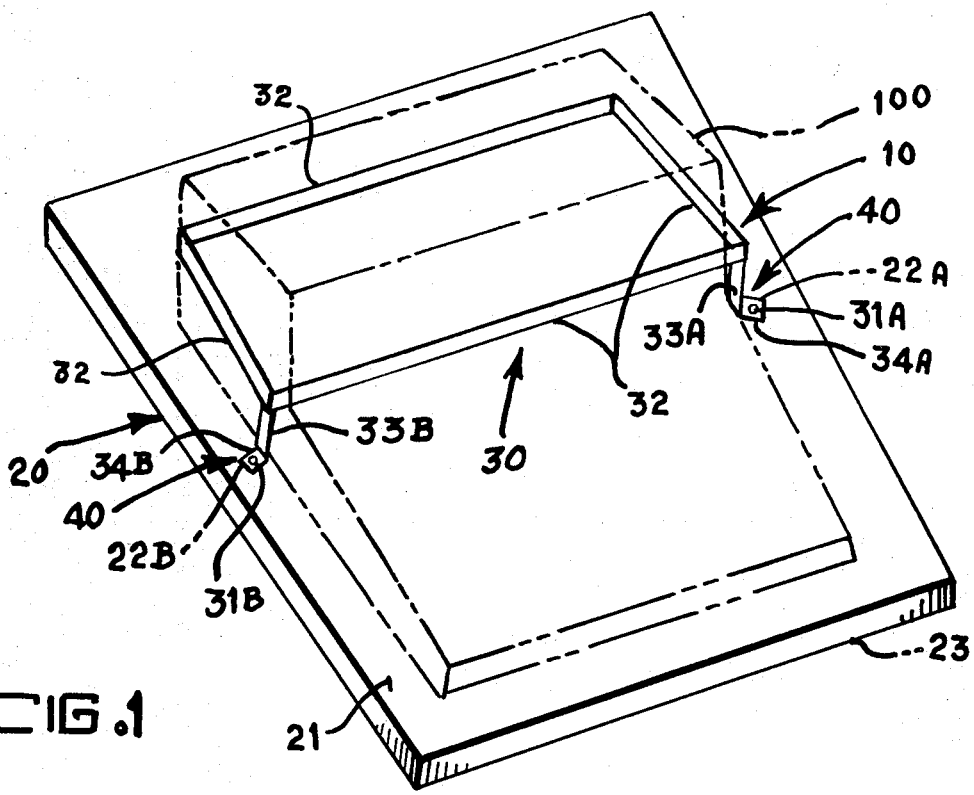
FIG. 1 is a perspective view, in simplified pictorial and schematic form, of a preferred embodiment of the instant invention in its working environment while protecting, and yet permitting the use of, a piece of representative computer-related equipment (i.e., a line printer)

With reference to FIG. 1, therein is shown a preferred embodiment 10 of the instant invention in a typical working environment, i.e., while protecting a preselected article (e.g., a computer-related line printer 100) against theft or unauthorized removal, without interfering with the use of the article 100.

Figure 2:
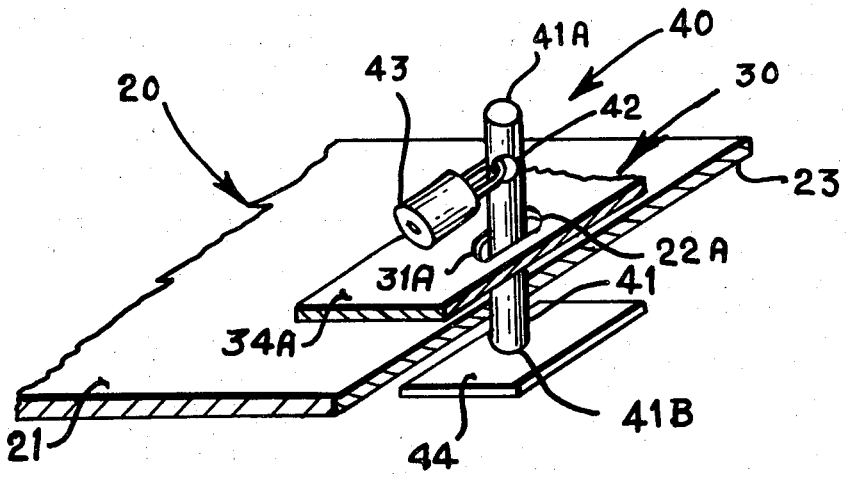
FIG. 2 is a perspective view in simplified pictorial and schematic form, of a component of the instant invention, with the component in its working environment, enlarged, and drawn not-to-scale.

In the most basic and generic structural form, the instant invention 10 comprises, in combination: a means (generally designated 20) for supporting the preselected article 100 which is to be protected, such as a desk or a table, preferably having a flat outer (e.g., upper) surface 21; a frame structure 30 which is dimensioned and configurated to enclose the preselected article 100, with the frame structure 30 fitted over and around the article 100, and also being in contact with the support means 20 in at least two locations on the outer surface 21; and a means (generally designated 40), FIGS. 1 and 2, for releasably connecting and locking the frame structure 30 to the support means 20.

It is to be noted that, at the two locations of contact, the support means 20 has respectively, openings 22A and 22B, FIGS. 1 and 2, through it from the outer surface 21 to the inner surface 22; and that, at the two locations of contact, the frame structure 30 has openings 31A and 31B, FIGS. 1 and 2, therethrough. The support means openings 22A and 22B are aligned with, respectively, frame structure openings 31A and 31B.

The means 40 for releasably connecting and locking the frame structure 30 to the support means 20 includes a retaining member 41, FIGS. 1 and 2 for each of the locations of contact between the frame structure 20 and the outer surface 21 of the support means 30. Each retaining member 41 is sized, shaped, and disposed such that a first end thereof 41A is positioned and captured above the outer surface 21 of the support means 20, and a second end thereof 41B is positioned and captured below the inner surface 23 of the support means 20, as is shown in FIG. 2.

Either the first end 41A or the second end 41B of each retaining member 41 has an opening 42, FIG. 2, through which a locking member 43, FIG. 2, is removably inserted, thereby preventing this end from passing through its corresponding aligned openings such as openings 22A and 31A, FIGS. 1 and 2. Whichever of the two ends 41A or 41B of each retaining member 41 that does not have the opening 42, has a plate-like member 44, FIG. 2, attached to this other end, thereby preventing this other end from passing through its corresponding aligned openings 22A and 31A, FIG. 2. As shown in FIG. 2, end 41A or retaining member 41 has the opening therethrough; and, end 41B of retaining member 41 has the plate-like member 44 attached to it. It is here to be noted that end 41B could have had the opening 42, and end 41A could have had the plate-like member 44, so that the retaining member 41 would appear inverted, as compared to its orientation as presently shown in FIG. 2. On the other hand, the retaining member 41 with opening 42 and plate 44, as presently shown in FIG. 2, could be merely and simply turned upside down, with the opening 42 and the plate 44 remaining at their present ends, i.e., 41A and 41B, of the retaining member 41. In this regard, and with reference to the retaining member 41, the length of the retaining member 41 should be sufficiently great that it can be used with the varying thicknesses of the various support means (i.e., distance between outer surface 21 and inner surface 22) that are or can be used, so that retaining members 41 of various different lengths need not be available, or have to be specially made.

As a matter of preference and not of limitation, the locking member 42, FIG. 2, is a padlock; the retaining member 41 is made of metal, and is rod-like in configuration; and the plate-like member 44 is made of metal (e.g., bar stock), and is welded to the retaining member 41.

The frame structure 30, FIG. 1, preferably includes a rectangular portion 32, and at least two support legs 33A and 33B extending from the rectangular portion 32 in parallel equal spaced-apart relationship. Each support leg 33A and 33B has a first end fixedly attached to the rectangular portion 32, and a second end having a flange (34A for leg 33A and 34B for leg 33B, FIGS. 1 and 2) by which the frame structure 30 is releasably connected and locked to the article supporting means 20 by the releasably connecting and locking means 40. More specifically, openings 31A and 31B in frame structure 30 are located, respectively, in flanges 34A and 34B.

As a matter of preference, the frame structure 30 is made of metal (e.g., bar stock) and it is padded (preferably with adhesive rubber padding) wherever the frame structure 30 comes in contact with the preselected article 100. This is not necessary, but merely out of an abundance of precaution in the unlikely event that the protected preselected article 100 can be marred by abrading contact with the frame structure 30.

Figure 3:
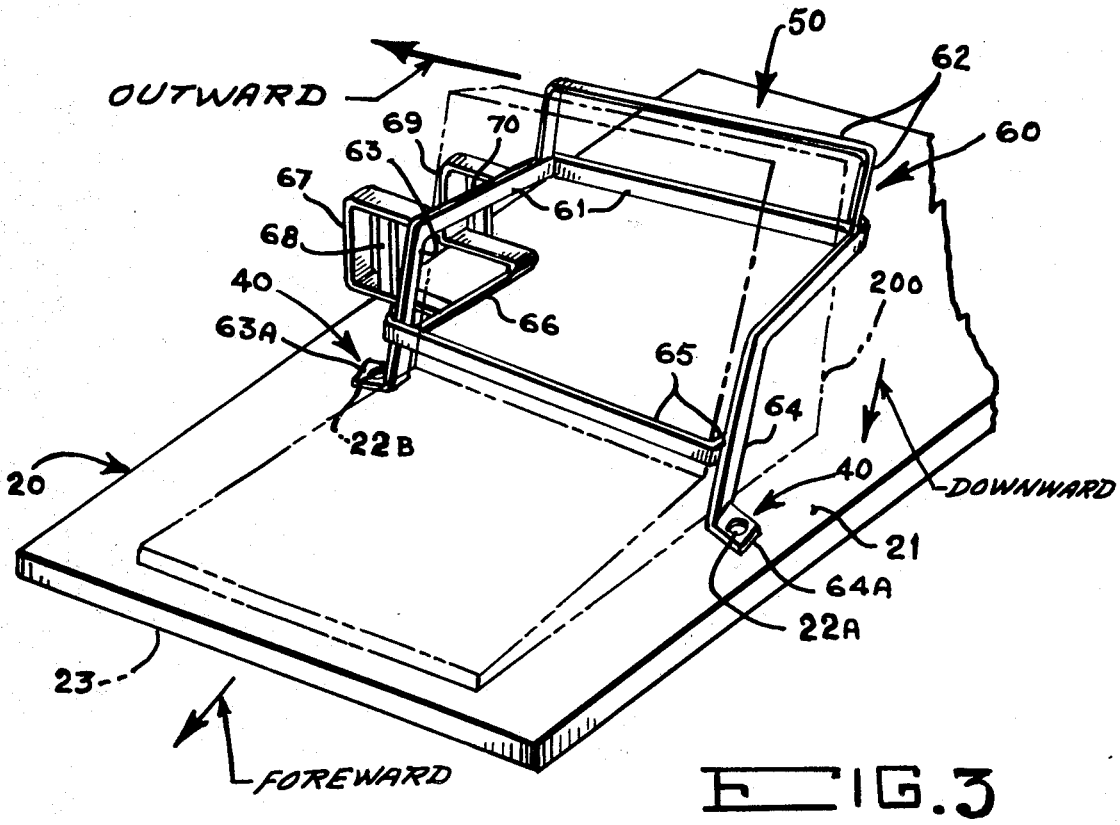
FIG. 3 also is a perspective view, in simplified pictorial and schematic form, of a variation of the preferred embodiment of the instant invention in its working environment while protecting, and at the same time permitting the use of, another piece of representative computer-related equipment (i.e., a video display terminal).

With reference to FIG. 3, therein is shown a variation 50 of the preferred embodiment 10, FIG. 1, in a typical working environment, i.e., while protecting a preselected article (e.g., a computer-related video display terminal 200) against theft or unauthorized removal, without interfering with the use of article 200.

As was the situation with the preferred embodiment 10, FIGS. 1 and 2, the variation 50, FIG. 3, composes, in combination: the means 20, FIGS. 1 and 2, for supporting the preselected article 200 which is to be protected; a frame structure 60, FIG. 3, which is dimensioned and configurated to enclose the preselected article 200, with the frame structure 60 fitted over and around the article 200, and also being in contact with the support means 20 in at least two locations on the outer surface 21; and, the means 40, FIGS. 1 and 2, for releasably connecting and locking the frame structure 60, FIG. 3, to the support means 20. Essentially, the difference between the preferred embodiment 10, FIGS. 1 and 2, and the variation thereof 50, FIG. 3, is the configuration (and dimensioning) of the frame structure 60, FIG. 1, as compared to frame structure 30, FIGS. 1 and 2. Stated another way, the article supporting means 20 and the releasably connecting and locking means 40 which are constituent components of the preferred embodiment 10, FIGS. 1 and 2, are also constituent components of the variation 50, FIG. 3. Accordingly, these means 20 and 40, need not be and will not be, described again hereat.

The frame structure 60, FIG. 3, of the variation 50, includes basically and essentially five U-shaped members, at least two supporting leg members, and at least two bar members, all of which are fixedly attached (preferably by welding) and are disposed relative to each other, such that the desired configuration of the frame structure 60 is attained.

More specifically, the frame structure 60, FIG. 3, includes: a first U-shaped member 61, which is inverted, and which is horizontally disposed with respect to the outer surface 21 of the article supporting means 20; a second U-shaped member, also inverted, but vertically disposed with respect to the first U-shaped member 61 and fixedly attached to member 61 by its (member 62) two leg portions; a first support leg member 63 and a second support leg member 64, with each support leg having a first end affixed to a different one of the two leg portions of the first U-shaped member 61, and a second end having a flange (63A for leg 63, and 64A for leg 64, FIG. 3) by which the frame structure 60 is releasably connected and locked to the article supporting means 20 by the releasably connecting and locking means 40; a third U-shaped member 65 horizontally disposed with respect to the outer surface 21 of the article supporting means 20, with each leg portion of this member 65 fixedly attached to a different one of the two support leg members 63 and 64 at a location intermediate the first and second ends of the support leg members 63 and 64, such that this third U-shaped member 65 is also concurrently disposed forward of the first U-shaped member 61; a support member 66 fixedly attached to the first support leg member 64 and extending rearwardly and downwardly therefrom; a fourth U-shaped member 67 extending outwardly from the support member 66, and having one leg portion fixedly attached to the support member 66, and also having another leg portion fixedly attached to a leg portion of the first U-shaped member 61, with a bar 68 fixedly attached to this fourth U-shaped member 67; and a fifth U-shaped member 69 extending outwardly from the support member 66, and having one leg portion fixidly attached to the support member 66 at a location rearwardly of the fourth U-shaped member 67, and having another leg portion fixedly attached to a leg portion of the first U-shaped member 61, with a bar 70 fixedly attached to the fifth U-shaped member 69 across the rear of that member 69.

As was the situation with regard to the frame structure 30 of the preferred embodiment 10, FIG. 1, the frame structure 60 of the variation 50, FIG. 3, preferably is made of metal (e.g., bar stock), and preferably it is padded (such as with adhesive rubber padding) wherever the frame structure 60 comes in contact with the preselected article 200.

MANNER OF USE OF THE PREFERRED EMBODIMENT AND VARIATION

The manner of use, and of operation, of the preferred embodiment 10, FIGS. 1 and 2, and of the variation 50, FIGS. 3 and 2, of the instant invention can be easily ascertained by any person of ordinary skill in the art, from the foregoing description, coupled with reference to the contents of the Figures of the drawing.

For others, the following explanation is given. Assuming either that preseleced article 100, FIG. 1, which represents a computer-related line printer or the like, or that preselected article 200, FIG. 3, which represents a computer-related video display terminal or the like, it is to be protected against theft or unauthorized removal and yet be useable while so protected, then the preselected article (such as 100 or 200) is placed on the outer (or top) surface 21 of a suitable support 20, such as a desk, a table, or the like. Next, the appropriate frame structure (such as 30, FIG. 1, or 60, FIG. 3, or the like) is placed and fitted over and around the article, with the support leg members (such as 33A and 33B, FIG. 1; or 63 and 64, FIG. 3) being in contact with the outer (or top) surface 21 of the support by way of the holed flanges (such as 34A and 34B, FIGS. 1 and 2; or 64A and 64B, FIG. 3) of the support leg members. Then, at the area of flange-to-support means contact, holes are formed through the outer (or top) surface 21 of the support 20 to the inner (or lower) surface 23 of the support 20, such that the holes in the flanges and the holes in the support are aligned. Next, a retaining member (such as 41, FIG. 2) with fixedly attached plate member (such as 44, FIG. 2) is inserted through each set of aligned holes. These two unified members 41 and 44 are positioned through the aligned holes either as shown in FIG. 2, or in an inverted mode, depending upon need or desire. Then a locking member 43 (e.g., a padlock) is inserted through the opening 42 in the locking member 43. Of course, a separate lock is used for each retaining member 41. As a result, the frame structure is releasably connected to and also locked to the support means; and, thereby, the preselected article is not only protected against theft, but also is still useable. To remove the preselected article for storage, repair, and the like, the above-described procedure is reversed, except of course for the forming of the holes in the support means.

CONCLUSION

It is abundantly clear from all of the foregoing, and from the contents of the Figures of the drawing, that the stated objects of the instant invention 10 (and its variation 50), as well as other objects related thereto, have been achieved.

It is to be noted that, although there have been described and shown the fundamental and unique features of the instant invention, as applied to a preferred embodiment 10 and a variation 50 thereof, nevertheless various other embodiments, variations, adaptations, substitutions, additions, omissions, and the like may occur to and can be made by those of ordinary skill in the art. For example, the instant invention can be used "as is", or can be adapted for use, to hold the preselected article in a vertical position, as compared to the horizontal position in which the preselected articles 100, FIG. 1, and 200, FIG. 3, are shown for illustrative purposes.

What is claimed is:

1. A security device for protecting a preselected article against theft, wherein said article is useable while being protected by said device, comprising:

a. a means for supporting said article;

b. a frame structure dimensioned and configured to enclose said preselected article with said frame structure fitted over and around said article, said frame structure being made of a rigid and substantially nonbendable material and including a rectangular portion, at least two support legs extending therefrom in parallel equal spaced-apart relationship, with each support leg having a first end fixedly attached to said rectangular portion, and a second end having a flange, said flange being in contact with said support means in order for said frame structure to be in contact in at least two locations on an outer surface of said support means, and said support means and said frame structure having aligned openings at each of said two locations of contact; and c. means for releasably connecting and locking said frame structure to said support means, wherein said releasably connecting and locking means includes a retaining member for each location of contact, with each retaining member sized, shaped, and disposed such that a first end thereof is positioned and captured above said outer surface of said support means, and a second end thereof is positioned and captured below an inner surface of said support means, with one of said first or second ends of each of said retaining members having an opening therethrough into which a locking member is removably inserted, thereby preventing this end from passing through its corresponding aligned openings, and the other of said first or second end of each of said retaining members having a plate-like member attached thereto, thereby preventing this end from passing through its corresponding aligned openings.

2. A security device, as set forth in claim 1 wherein each said retaining member, and each said plate-like member, is made of metal.

3. A security device for protecting a preselected article against theft, wherein said article is useable while being protected by said device, comprising:

a. a means for supporting said article;

b. a frame structure dimensioned and configured to enclose said preselected article with said frame structure fitted over and around said article, said frame structure being made of a rigid and substantially nonbendable material and including a first U-shaped member, inverted, and horizontally disposed with respect to said article supporting means, a second U-shaped member, inverted, vertically disposed with respect to said first U-shaped member and fixedly attached thereto by its two leg portions, first and second support leg members extending from said first U-shaped member with each support leg having a first end affixed to a different one of two leg portions of said first U-shaped member, and a second end of each of said support leg members having a flange in contact with said support means in order for said frame structure to be in contact with said support means in at least two locations on an outer surface of said support means, a third U-shaped member horizontally disposed with respect to said article supporting means, with each leg portion thereof fixedly attached to a different one of said two support leg members intermediate said first and second ends of said support leg members, such that said third U-shaped member is also disposed forward of said first U-shaped member, a support member fixedly attached to said first support leg member and extending rearwardly and downwardly therefrom, a fourth U-shaped member extending outwardly from said support member, and having one leg portion fixedly attached to said support member, and also having another leg portion fixedly attached to a leg portion of said first U-shaped member, with a bar fixedly attached to said fourth U-shaped member across the front thereof, and a fifth U-shaped member extending outwardly from said support member and having one leg portion fixedly attached to said support member rearwardly of said fourth U-shaped member, and having another leg portion fixedly attached to a leg portion of said first U-shaped member, with a bar fixedly attached to said fifth U-shaped member across the rear thereof, and said support means and said flanges having aligned openings at each of said two locations of contact; and c. means for releasably connecting and locking said frame structure to said support means, wherein said releasably connecting and locking means includes a retaining member for each location of contact, with each retaining member sized, shaped and disposed such that a first end thereof is positioned and captured above said outer surface of said support means, and a second end thereof is positioned and captured below an inner surface of said support means, and wherein one of said first or second end of each of said retaining members has an opening therethrough into which a locking member is removably inserted thereby preventing this end from passing through its corresponding aligned openings, and the other of said first or second end of each of said retaining members having a plate-like member attached thereto, thereby preventing this end from passing through its corresponding aligned openings.

4. A securing device, as set forth in claim 3, wherein said frame structure is made of metal.

5. A security device, as set forth in claim 4, wherein said frame structure is padded wherever said frame structure comes in contact with said preselected protected device.

* * * * *